US008713965B1

(12) United States Patent
Tillery

(10) Patent No.: US 8,713,965 B1
(45) **Date of Patent: *May 6, 2014**

(54) ATTACHMENT TO CONVERT A BROOCH TO A PENDANT

(76) Inventor: David Allen Tillery, Bay Minette, AL (US)

( * ) Notice: Subject to any disclaimer, the term of this patent is extended or adjusted under 35 U.S.C. 154(b) by 220 days.

This patent is subject to a terminal disclaimer.

(21) Appl. No.: 13/317,192

(22) Filed: Oct. 12, 2011

Related U.S. Application Data

(63) Continuation-in-part of application No. 12/113,376, filed on Oct. 12, 2011.

(51) Int. Cl.
*A44C 1/00* (2006.01)

(52) U.S. Cl.
USPC ..... 63/1.17; 63/20

(58) Field of Classification Search
None
See application file for complete search history.

(56) References Cited

U.S. PATENT DOCUMENTS

| | | | |
|---|---|---|---|
| 992,659 | A | 5/1911 | Hartoch |
| 2,225,890 | A | 12/1940 | Schwarzkopf |
| 2,274,269 | A | 2/1942 | Markus |
| 2,357,782 | A | 9/1944 | Noah |
| 2,548,140 | A | 4/1951 | Bohlinger |
| 3,850,010 | A | 11/1974 | Noto |
| 4,276,757 | A | 7/1981 | Boening |
| 4,377,939 | A | 3/1983 | Reinsdorf |
| 5,245,844 | A | 9/1993 | Panzer |
| 5,921,110 | A | 7/1999 | Middendorff et al. |
| 7,120,974 | B2 | 10/2006 | Suganuma |
| 7,225,638 | B2 | 6/2007 | Loeff et al. |

*Primary Examiner* — Jack W. Lavinder

(57) ABSTRACT

An attachment for an article of jewelry called a brooch enabling the brooch to be worn as a pendant. The attachment comprises a body, a head, and a tail. The body contains one or multiple pin holes into which the pin stem of the brooch is inserted. The head extends upward from the body and contains the necklace hole. The tail, which flexes upon closure of the pin stem, extends downward from the body and covers the back of the brooch below the pin stem. When engaged on the back of a brooch, the attachment will bear on the back of the brooch above and below the pin stem and prevent rotation of the attachment about the pin stem. The body encloses the pin stem and prevents the pin stem from contacting the wearer, protecting the wearer from injury.

7 Claims, 6 Drawing Sheets

ATTACHMENT TO CONVERT A BROOCH TO A PENDANT

CROSS-REFERENCE TO RELATED APPLICATIONS

This application is a continuation-in-part of application Ser. No. 12/113,376 filed on Oct. 12, 2011 by the present inventor ((This application claims the benefit of a Provisional Patent Application (Appl. No. 60/899,419) filed by the present inventor)).

FEDERALLY SPONSORED RESEARCH

N/A

SEQUENCE LISTING OR PROGRAM

N/A

BACKGROUND

Field of Invention

My invention relates to an attachment for the back of a brooch that will allow said brooch to be worn as a pendant. Brooches are pieces of jewelry designed to be worn on clothing. They are often referred to as "pins" because they have a pin on the back side that pierces the clothing and is locked into place with a locking device. Brooches tend to vary in size and the pin stem can vary in length.

Attempts have been made in the past to make brooches available as pendants. Some brooches were made with hooks on the back so that they would hook over a necklace. Hooks were not widely accepted because the brooch would often slip off the hook and be lost. And if hooks were soldered on at a later date, the value of the piece was diminished. Any physical permanent alteration to the brooch reduced it's value dramatically. Therefore, few people who valued their jewelry would add a hook so that it could be worn as a pendant.

Still, other attempts were made by soldering two metal tubes together or by soldering two metal rings on a tube. One of the tubes would be smaller and would fit over the pin stem of the brooch and the other one would be larger and would serve to contain the necklace. In the case of the rings, a ring would be soldered on each end of the smaller tube and the two rings would serve to contain the necklace. All these were custom made and required the expertise of a jewelry or some similar craftsman. These types of devices were not well received because they tended to rotate about the pin stem unless specially braced. And being made of metal, these tubes could not be easily altered to accommodate pin stems of varying lengths.

Inventors Boening (U.S. Pat. No. 4,276,757) and Bohlinger (U.S. Pat. No. 2,548,140) invented devices that would prevent rotation about the pin stem by bracing above and below the pin stem. Boening's device addresses the issue of pin stem length because it grips the pin stem and does not allow it to slide back and forth. However, wearer comfort is not addressed as his device, which lays under the pin stem, leaves the pin stem, the hinge, the latch and the gripping fingers laying against the body when a brooch with his device is worn as a pendant. Bohlinger's device, which lays over the pin stem, tried to address the comfort issue by covering the pin stem horizontally with a narrow flat plane. The flat plane on his device does protect the wearer from the pin stem, the hinge and the locking device but it does little to protect the wearer from any sharp projections on the brooch itself. Neither does his device address the issue of varying pin stem lengths. One size does not fit all. His devices must be custom made to fit individual brooches or, if too short, will slide back and forth on the pin stem leaving the hinge and the latch to contact the skin. Neither inventor addresses the issue of the cosmetic presentation of the brooch. Noto (U.S. Pat. No. 3,850,010) invented a device that will telescope to completely cover the pin stem when closed in the latch. The device uses a screw and lock nut to secure it in the extended position. Like Boening's device, Noto's device left the hinge, the latch, and his device to lay against the body.

OBJECT OF THE INVENTION

The object of my invention is to address all past issues concerning an attachment to allow a brooch to be worn as a pendant, all in a single device—to prevent it's rotation about the pin stem, to prevent it from sliding back and forth on the pin stem, to make it comfortable for the wearer by having a broad flat surface contact the skin protecting the wearer from any sharp projections on the back of the brooch, to facilitate the most cosmetic presentation of the brooch when worn as a pendant, to make it adjustable so as to fit virtually any brooch.

SUMMARY

My invention is an attachment for the back of a brooch that will enable that brooch to be worn as a pendant. The attachment is made from a polymer and can be adjusted to fit almost any brooch.

Brooches are made with a hinged pin stem on the back, the hinge of a pin stem being called the joint. The pin stem closes into a catch and is secured in the catch with a rotor. The pin stem can run horizontally, vertically, or at a slant. This attachment is designed for a brooch with a horizontal pin stem. Viewed in cross section, the slot in the catch generally slants upward and backward toward the top of the brooch at an angle. When worn on the clothing, the weight of the broach forces the pin stem up and into the catch helping to secure it. The brooch is further secured by closing the rotor over the pin stem. The pin stem can be of various lengths depending on the size of the brooch and can be positioned at various distances from the top of the brooch.

This attachment is composed of a body, a head, and a tail.

The body is the central part of the attachment. It is composed of a central core with wings extending parallel to the horizontal axis from each side. The core is the geometric center of the attachment and has one or more pin holes running parallel to the horizontal axis through which the pin stem of the brooch will pass. If the attachment has more than one pin hole the wearer can vary the vertical position of the necklace hole, thereby altering the cosmetic presentation of the brooch, as the necklace will emerge from behind the brooch in different locations depending on which pin hole is chosen. The wings, being extensions of the core, also have pin holes through which the pin stem of the brooch will pass. The pin holes of the wings align with the aforementioned pin holes of the core. The wings have cutting grooves spaced equidistant along each wing. The cutting grooves reduce the thickness of the wings so that the wings are easy to cut through at that point, thereby reducing the overall width of the attachment and enabling the pin holes of the body and the wings to completely enclose the pin stem of the brooch when the attachment is engaged on the back of the brooch and the pin stem is closed into the catch. Rising from the floor of each cutting groove beneath each pin hole in that groove is a stop that extends to and forms a portion of the inner wall of each pin hole. These stops contact the joint on one end of the pin stem and the catch on the other end, preventing the attachment from sliding from side to side when engaged on a brooch. The thickness of the attachment from the center of the pin holes to the back of the attachment is greater than the radius of the catch or the joint, effectively keeping the catch or the joint from contacting the skin of the wearer when the attachment is engaged on the back of the brooch and the brooch is being worn as a pendant.

The head is a upward vertical extension of the body. It is composed of the bale and two triangular panels. The bale forms and contains the necklace hole, the necklace hole running parallel to the horizontal axis of the attachment through the head. The necklace hole is made oblong to allow for the passage of the oversized latches of some necklaces. The upper most inner wall of the bale is downwardly convex eliminating a two point contact with hard necklaces and allowing the pendant to move smoothly from side to side. The head is made rigid by increasing the wall thickness of the proximal and distal walls of the necklace hole to the extent that the walls will not collapse when the attachment is engaged on the back of the brooch with the pin stem closed into the catch and the tail flexed. The entire head is made thick in cross section so that it will touch the back of the brooch before the pin stem can be closed into the locking device, rotating the attachment about the pin stem and causing an upward divergence between the vertical axis of the brooch in cross section and a line down the back of the head and the body in cross section. This divergence pushes the top of the brooch forward and gives a face forward presentation of the brooch when worn against a sloping chest.

Triangular panels on each side of the bale are part of the head. They are horizontal extensions of the back of the head that connect vertically with the wings. Along with the backs of the body, the wings, and the head, the triangular panels form the broad flat plane on the back of the attachment that rests against the chest of the wearer. Their function is to increase the area of the back that lays against the chest making the brooch more comfortable to wear and protecting the wearer from any sharp projections on the back of the brooch.

The tail is a downward vertical extension of the body. It is turned down at an angle relative to the body. The tail is made thin and of a material that it will flex when the attachment is engaged on the back of a brooch. When pressure is applied to engage the pin stem into the catch, the tail will flex. This flexure will keep the tail against the brooch below the pin stem and will keep the head against the brooch above the pin stem. It will also keep the pin stem pulled up and into the catch even if the rotot is not closed. As a result the attachment will not rotate about the pin stem.

The tail has horizontal cuts between the side panels of the tail and the wings and vertical cuts merging with the inner most part of the horizontal cuts extending downward parallel to the vertical axis of the tail. That portion of the tail between the two vertical cuts immediately below the core is the area of primary flexure. The area of primary flexure is of constant width, length, and thickness. It is never cut, insuring that the amount of tension placed on any stem pin is always constant no matter how the attachment is altered to fit a brooch.

The tail has two vertical scribe lines each with a notch at the base of the tail to easily locate the beginning of each scribe line. These scribe lines run parallel to the vertical axis of the tail and bisect the vertical cuts in the tail. They demarcate the side panels from the central part of the tail. The side panels are designed to cover the entire back of the brooch below the pin stem. By cutting down these two scribe lines the wearer can remove the side panels when he/she feels that they are not needed. The tail is long and will extend below the bottom of the brooch. At initial placement, when the attachment is locked in place, the tail is marked, removed, and trimmed to fit so that it touches at the bottom of the brooch and closely conforms to the shape of the brooch. The tail will cover and protect the wearer from any sharp projections on the back of brooch below the pin stem.

Since brooches are often of an indeterminate shape, the attachment was designed in a standard shape to be trimmed and customized for each individual brooch.

DRAWINGS

Figures

DRAWINGS

List of Reference Numerals

Figure 1:
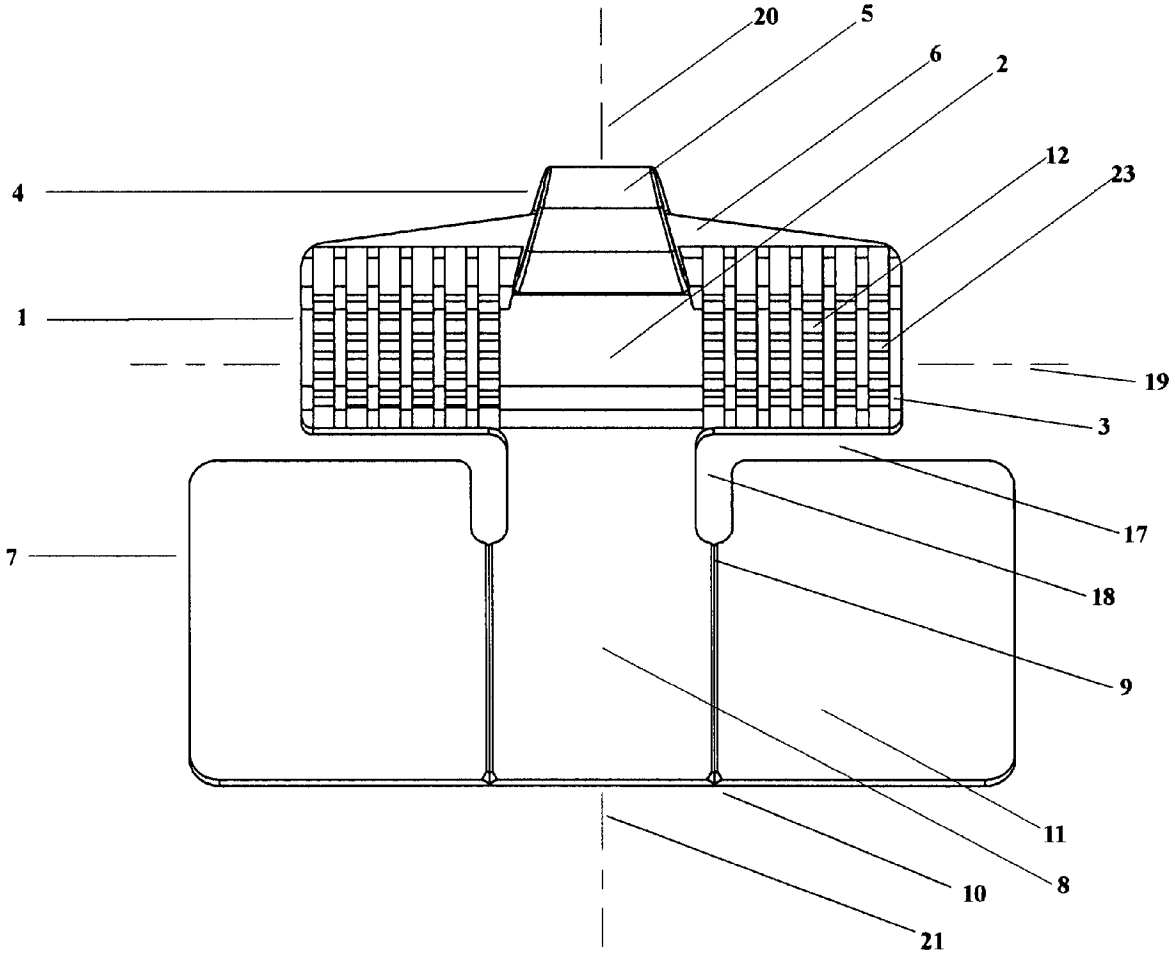
FIG. 1 is a front view of the attachment laying on it's back showing the parts comprising the attachment, the cutting grooves in the wings, the scribe lines and notches in the tail, the horizontal and vertical cuts in the tail, and the horizontal and vertical axes of the attachment.
Figure 2:
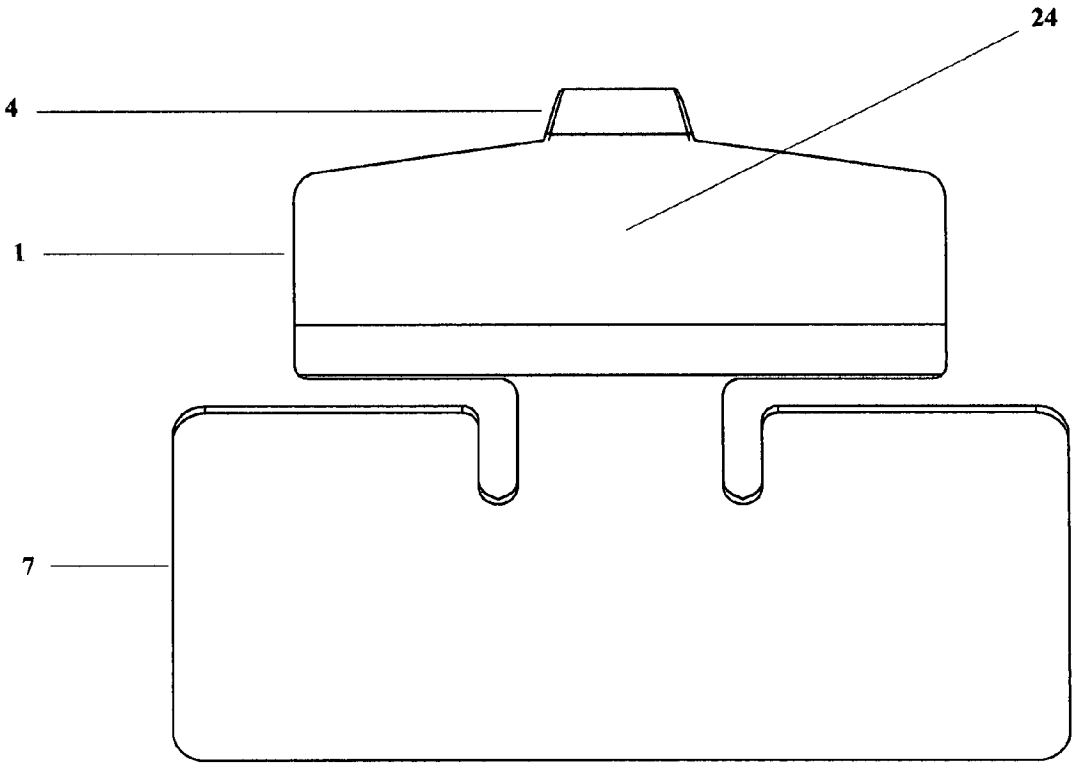
FIG. 2 is a back view of the attachment showing the broad flat plane that will rest against the chest of the wearer.
Figure 3:
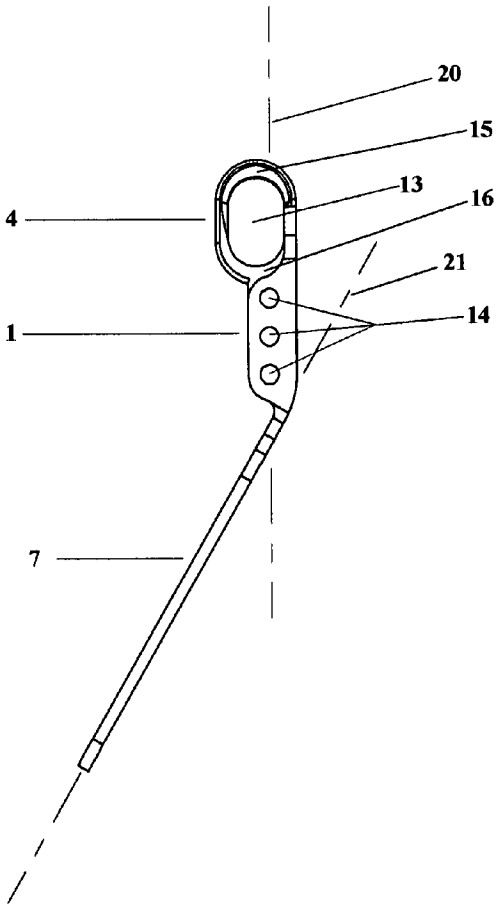
FIG. 3 is a side view of the attachment showing the multiple pin holes, the necklace hole, the turned down tail, the vertical axis of the attachment, and the vertical axis of the tail.
Figure 4:
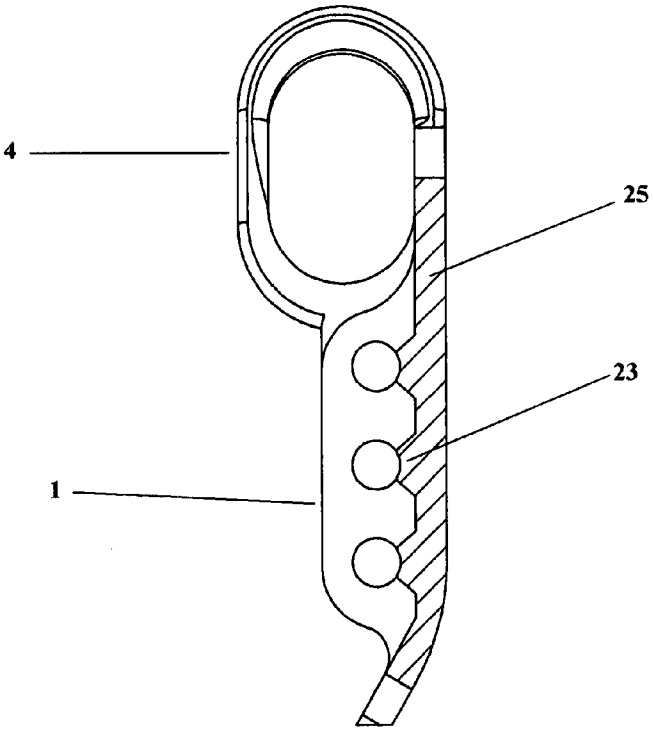
FIG. 4 is a sectional view of a wing of the body on the horizontal axis of the attachment bisecting one of the cutting grooves, showing the floor of a cutting groove with the stops rising from the floor beneath the pin holes and becoming a part of the wall of the pin holes.
Figure 5:
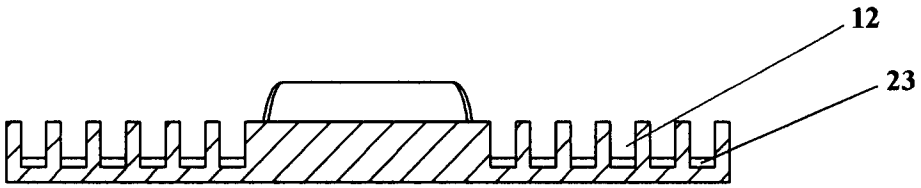
FIG. 5 is a sectional view of the body on the vertical axis of the attachment showing the cutting grooves and the stops.
Figure 6:
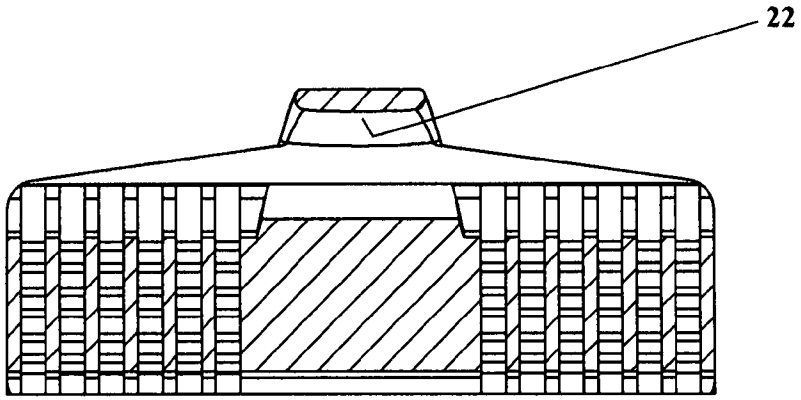
FIG. 6 is a sectional view of the bale of the head showing the downward convex shape of the upper most inner wall of the necklace hole.

| | |
|---|---|
| 1. | Body |
| 2. | Central core of the body |
| 3. | Wing(s) of the body |
| 4. | Head |
| 5. | Bale of the head |
| 6. | Triangular panel(s) of the head |
| 7. | Tail |
| 8. | Center of the tail |
| 9. | Scribe line(s) on the tail |
| 10. | Notch at the base of a scribe line |
| 11. | Side panel(s) of the tail |
| 12. | Cutting groove(s) |
| 13. | Necklace hole |
| 14. | Pin hole(s) |
| 15. | Distal wall of the necklace hole |
| 16. | Proximal wall of the necklace hole |
| 17. | Horizontal cut(s) of the tail |
| 18. | Vertical cut(s) of the tail |
| 19. | Horizontal axis of the attachment |
| 20. | Vertical axis of the attachment |
| 21. | Vertical axis of the tail |
| 22. | Upper most inner wall of the bale |
| 23. | Stop |
| 24. | Broad flat plane on the back of the attachment |
| 25. | Floor of a cutting groove |

DETAILED DESCRIPTION OF THE PREFERRED EMBODIMENT

My invention is a unitary attachment made from a polymer that, when attached to a brooch, will allow the brooch to be worn as a pendant. A brooch is a piece of jewelry that is worn by pinning it on the clothing. A brooch has a pin stem on it's back that hinges on one end and closes into a catch on the opposite end. Once the pin stem has pierced the clothing, said pin stem is closed, inserted into a slot in the catch and secured there with a rotor.

The attachment is composed of a body 1, a head 4, and a tail 7.

The body 1 is the central part of the attachment composed of a central core 2 and two wings 3 extending parallel to the horizontal axis of the attachment 19 in opposite directions from the core 2. The body 1 has one or more pin holes 14 running parallel to the horizontal axis of the attachment 19 into which the pin stem on the back of a brooch will pass. Equally spaced cutting grooves 12 running parallel to the vertical axis of the attachment 20 are cut into the wings 3. Rising off the floor of each cutting groove 25 and forming is a portion of the wall of the pin holes 14 are stops 23. These stops 23 rest against the catch and the joint of the pin stem and prevent the attachment from sliding from side to side.

The head 4 is an upward vertical extension of the body 1. The head 4 is composed of a bale 5 and two triangular panels 6 extending parallel to the horizontal axis of the attachment in opposite directions from the back of the bale 5. The bale 5 contains a necklace hole 13 running parallel to the horizontal axis of the attachment, the upper most inner wall of the bale 22 being convex in nature. The proximal 16 and distal walls 15 of the bale 5 are made sufficiently thick so that the necklace hole 13 will not collapse when the pin stem is closed into the catch and the tail 7 is flexed. The triangular panels 6 are horizontal extensions of the back of the bale 5 that connect vertically with the wings 3 of the body 1. These triangular panels 6 serve to increase the area of the broad flat plane on the back of the attachment 24.

The tail 7 is a downward vertical extension of the body 1. However, it does not fall on the vertical axis of the attachment when viewed from the side. The tail extends down and immediately turns toward the front of the attachment at an angle. The tail 7 is composed of the center of the tail 8 and two side panels 11. The center of the tail extends the full length of the tail and is that part of the tail that flexes when the attachment is engaged on the back of a brooch. The tail has two side panels 11 located horizontally adjacent to the center of the tail and separated from the center of the tail 8 by two scribe lines 9, each with a notch 10 at it's base. The scribe lines bisect the vertical cuts of the tail and are parallel to the vertical axis of the tail 21. The side panels 11 are separated vertically from the wings by a horizontal cut 17. A vertical cut 18 connects with the inner most part of the horizontal cut 17 and extends downward parallel to the vertical axis of the tail.

CONCLUSION, RAMIFICATIONS, AND SCOPE OF THE INVENTION

My invention provides a safe way to take those old but beautiful brooches out of storage and start to wear them as pendants. And there is no need to alter or damage those valuable brooches to do so. In the past, only a jewelry or similar craftsman could custom build an attachment that would allow you wear a brooch as a pendant. With this attachment, anyone with a pair of scissors can do it.

The invention claimed is:

1. An attachment made of a polymer for converting a brooch with a horizontal mounting pin stem to a pendant so said pendant can be suspended from a necklace, said attachment comprising a central body with one or more horizontal pin holes running parallel to a horizontal axis of said attachment, a head extending vertically upward from said body forming and containing a necklace hole which runs parallel to the horizontal axis of said attachment, said head extending the same width as said body, a tail extending vertically downward from said body at an angle toward a front of said attachment relative to a vertical axis of said attachment in cross section, said tail extending more than the full width of said body and said head.

2. An attachment according to claim 1, said body has multiple equally spaced cutting grooves in a front surface of said body, running parallel to the vertical axis of said attachment, whereby a line bisecting each said cutting groove is perpendicular to the horizontal axis of said attachment.

3. An attachment according to claim 1, said tail has a horizontal cut between said tail and said body and a vertical cut intersecting with said horizontal cut at said horizontal cut's inner most point, extending downward parallel to the vertical axis of said tail.

4. An attachment according to claim 1, said tail has two scribe lines on a front surface of said tail with a notch at a base of each scribe line, whereby each said scribe line runs parallel to the other and to the vertical axis of said tail, and is aligned with a line bisecting said vertical cut of said tail.

5. An attachment according to claim 1, further comprising a broad flat plane located on the back of said attachment that will lay against a chest of a wearer of the attachment, said flat plane encompassing the back of said body and said head, extending horizontally the full width of said body and said head.

6. An attachment according to claim 1, said head has a downward convex surface on the upper most inner wall of said necklace hole.

7. An attachment according to claim 1, said body has stops rising from the floor of said cutting grooves beneath each said pin hole, forming a part of the inner wall of said pin holes.

* * * * *